US005692672A

United States Patent [19]

Hunt

[11] Patent Number: 5,692,672

[45] Date of Patent: Dec. 2, 1997

[54] CONTAINER END CLOSURE ARRANGEMENT

[75] Inventor: Terry W. Hunt, Milan, Ill.

[73] Assignee: Jefferson Smurfit Corporation, Clayton, Mo.

[21] Appl. No.: 699,724

[22] Filed: Sep. 3, 1996

[51] Int. Cl.[6] ..... B65D 5/24

[52] U.S. Cl. ..... 229/128; 229/931

[58] Field of Search ..... 229/128, 137, 229/138, 931

[56] References Cited

U.S. PATENT DOCUMENTS

| | | | |
|---|---|---|---|
| 2,643,813 | 6/1953 | Vines | 229/931 X |
| 2,799,442 | 7/1957 | Van Rosen | 229/128 |
| 3,010,571 | 11/1961 | Transport | 229/128 X |
| 3,342,399 | 9/1967 | Reynolds | 229/931 X |
| 3,792,810 | 2/1974 | Tingley et al. | 229/128 |
| 3,929,222 | 12/1975 | Smith et al. | 229/128 X |
| 4,069,917 | 1/1978 | Stollberg et al. | 229/128 X |
| 4,130,237 | 12/1978 | Struble | 229/128 X |

*Primary Examiner*—Allan N. Shoap
*Assistant Examiner*—Christopher J. McDonald
*Attorney, Agent, or Firm*—Richard W. Carpenter

[57] ABSTRACT

An improved end closure arrangement for a paperboard container which, when moved to closed position, will remain in a closed position without springing back to an open position. The closure arrangement includes a pair of outer end closure flaps interconnected by a pair of inner bellows members each of which includes three panel elements. The panel elements are foldably joined to a container end wall and to each other along spaced fold lines and are separated from each other by U-shaped cut lines that enable the container closure flaps, when folded to a closed position, to remain in a closed position without springing back to open position.

20 Claims, 2 Drawing Sheets

FIG. 1
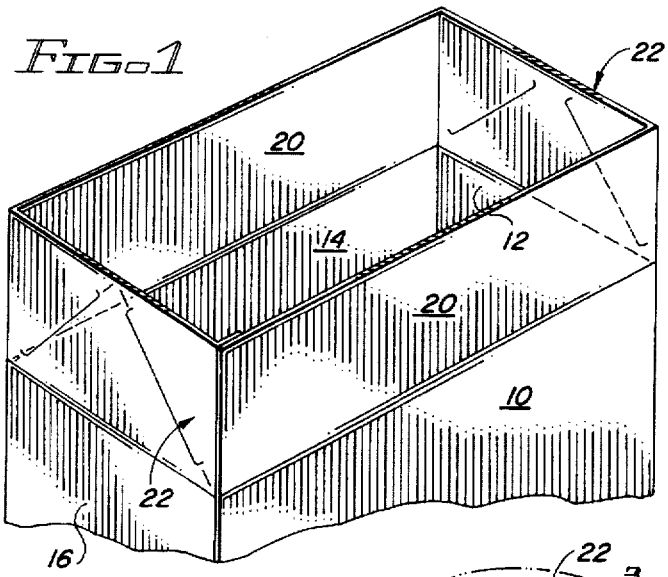
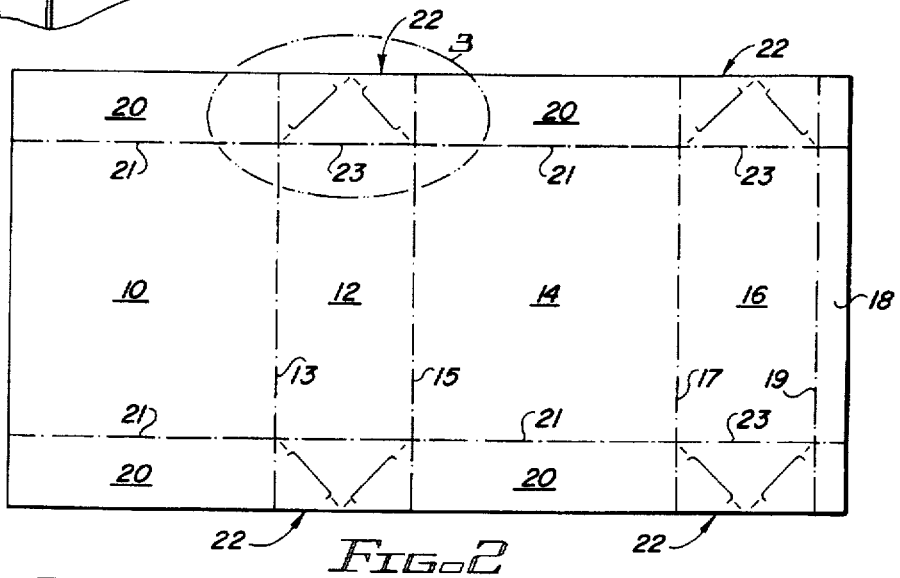
FIG. 2
FIG. 3
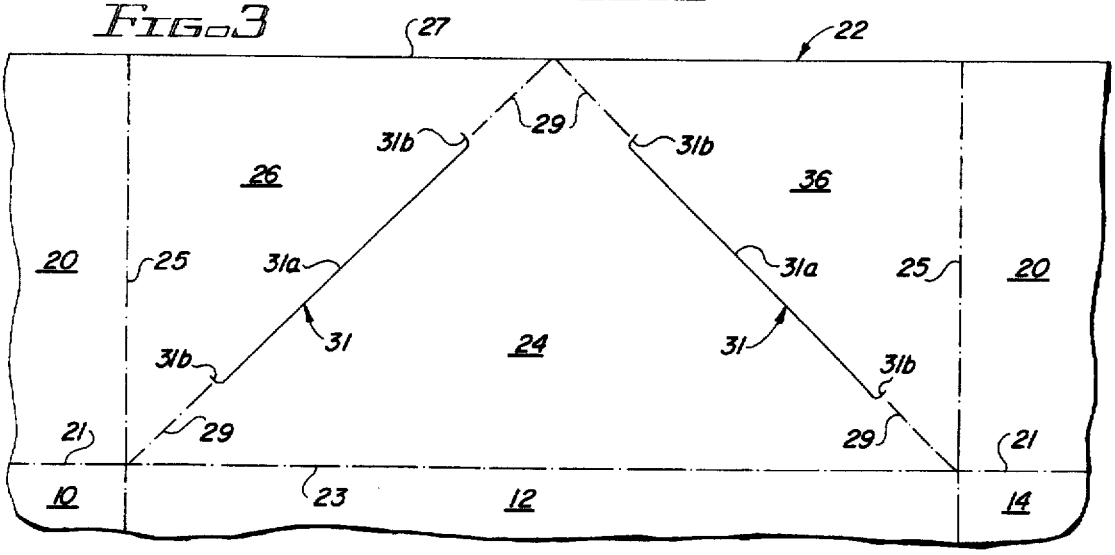

CONTAINER END CLOSURE ARRANGEMENT

BACKGROUND OF THE INVENTION

1. Field of the Invention

This invention relates to paperboard containers, and more particularly to an arrangement for closing an end of a tubular container wherein when end closure flaps are folded to closed position they will remain in closed position without springing back to open position.

2. Description of the Background Art

A background art search directed to the subject matter of this invention conducted in the United States Patent and Trademark Office disclosed the following U.S. Pat. Nos.:

| | | |
|---|---|---|
| 671,759 | 3,117,710 | 4,279,375 |
| 4,721,243 | 5,337,538 | 5,413,273 |

None of the patents uncovered in the search discloses an end closure arrangement for a paperboard container that includes a pair of rectangular outer closure flaps interconnected by a pair of bellows members that each include a pair of triangular side panel elements foldably joined to the outer closure flaps and a triangular center panel element foldably joined to a container end wall and to both side panel elements along spaced fold lines and separated from the side panel elements by U-shaped cut lines that enable the bellows panel elements, after being folded to closed position with the bellows side panel elements interposed between the end closure flaps and the center panel element, to remain in closed position without springing back to open position.

SUMMARY OF THE INVENTION

It is a primary object of the invention to provide an improved end closure arrangement for a paperboard container which, when moved to closed position, will remain in a closed position without springing back to an open position.

Another object of the invention is the provision of a container end closure arrangement of the type described which includes a pair of outer end closure flaps interconnected by a pair of inner bellows members each of which includes a plurality of panel elements foldably joined to the body of the container and to each other.

A more specific object of the invention is to provide an end closure arrangement for a paperboard container that includes a pair of rectangular outer closure flaps interconnected by a pair of bellows members that each include a pair of triangular side panel elements foldably joined to the outer closure flaps and a triangular center panel element foldably joined to a container end wall and to both side panel elements along spaced fold lines and separated from the side panel elements by U-shaped cut lines.

These and other objects of the invention will be apparent from an examination of the following description and drawings.

BRIEF DESCRIPTION OF THE DRAWINGS

FIG. 1 is an isometric view of the upper end of a container having a closure arrangement embodying features of the invention, with the container shown in an open position.

FIG. 2 is a plan view of a blank of foldable sheet material from which the container illustrated in the other views may be formed.

FIG. 3 is an enlarged view of a portion of the structure illustrated in FIG. 2.

It will be understood that, for purposes of clarity, certain elements may have been omitted from certain views where they are believed to be illustrated to better advantage in other views.

DESCRIPTION OF THE PREFERRED EMBODIMENT

Figure 4:
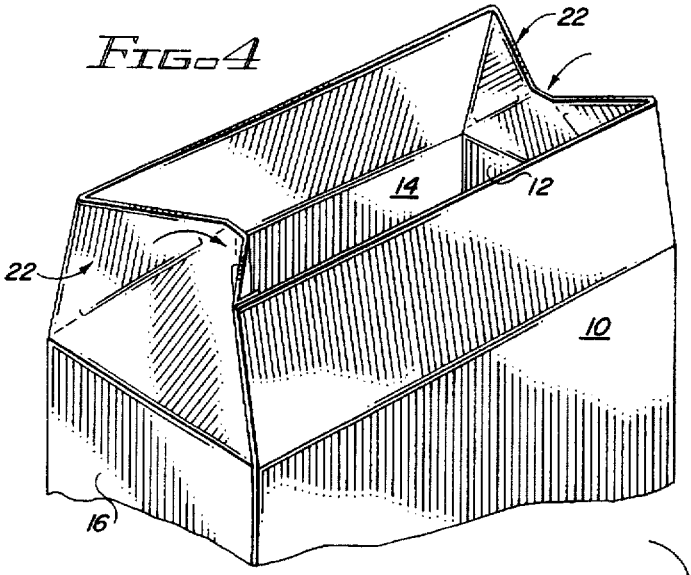
FIGS. 4–6 are views similar to that of FIG. 1, but showing various steps in moving the container end closure arrangement to a closed position.
Figure 5:
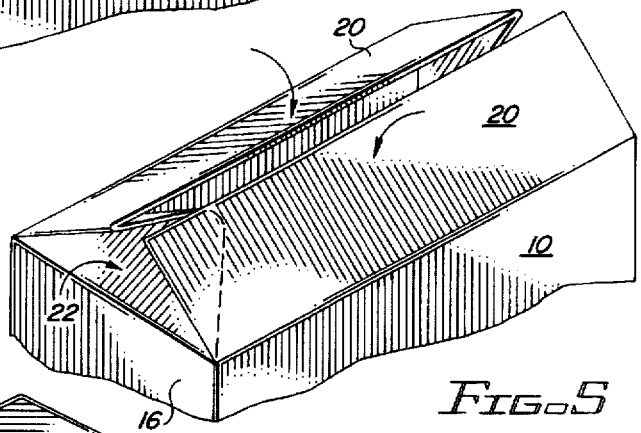
Figure 6:
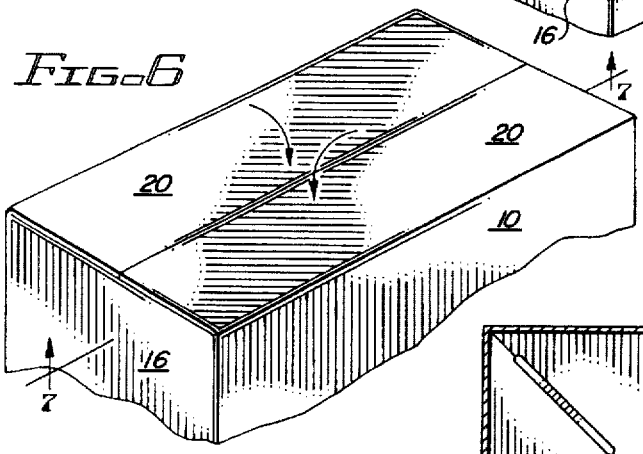
Figure 7:
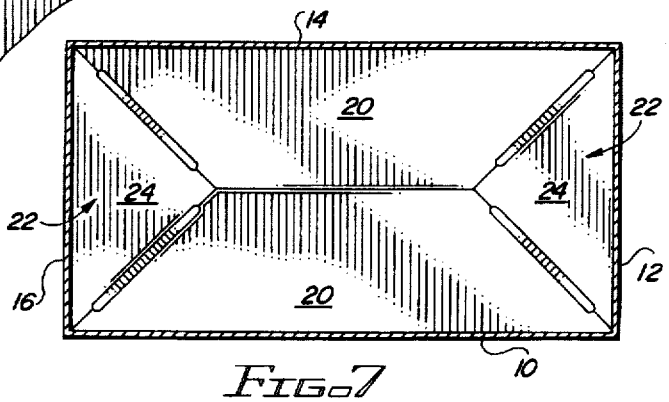
FIG. 7 is a horizontal cross sectional view taken on line 7—7 of FIG. 6.

Referring now to the drawings for a better understanding of the invention, it will be seen that the container indicated generally at C in FIGS. 1 and 4–7 may be formed from the unitary blank B of foldable paperboard illustrated in FIGS. 2 and 3.

As best seen in FIGS. 1 and 2, the main or body portion of container C includes a first major side wall panel 10, a first minor side wall panel 12, a second major side wall panel 14, a second minor side wall panel 16, and a glue flap 18 foldably joined to each other along parallel fold lines 13, 15, 17, and 19.

When container 0 is erected it is in the form of a tubular structure each end of which may be closed by a closure arrangement that includes a pair of generally rectangular outer closure flaps 20, foldably joined to adjacent end edges of container major side wall panels 10 and 14 along fold lines 21, and inner closure flaps that form bellows member 22, foldably joined to adjacent end edges of container minor side wall panels 12 and 16 along fold lines 23.

As best seen in FIG. 3, each bellows member 22 includes a a generally triangular center panel element 24 having a first side edge foldably joined to an adjacent end edge of a related one of said minor side wall panels along a fold line 23, and having a pair of second edges extending diagonally toward each other from opposite ends of fold line 23 and converging at a location spaced from and aligned with a midpoint of fold line 23.

Each bellows member 22 also includes pair of generally triangular side panel elements 26 each having first side edges foldably joined to adjacent end edges of related outer closure flaps 20 along fold lines 25, having free second edges 27 extending from and normal to said first edges to the previously mentioned location, and having third edges extending diagonally between remote ends of said first and second edges;

Each of the side panel elements 26 has end portions of each of its third edges foldably joined to an adjacent one of said center panel elements second edges, along a pair of fold lines 29 spaced from each other, and has a central portion of each of its third edges separated from an adjacent one of the center panel elements second edges by a generally U-shaped cut 31 having a straight central portion **31*a* and a pair of end portions 31*b*** extending from and normal to opposed ends of the central portion.

It should be noted that the straight central portions **31*a* of the generally U-shaped cut lines 31 are actually located in the area of the center panel elements 24; whereas, the end portions 31*b* of the cut lines 31 extend from within central panel element 24 into related side panel elements 26**.

The effect of the combination of the spaced fold lines and the central U-shaped cut lines is to cause the outer closure flaps 20 to lie flat with the side panel elements 26 of each bellows member 22 sandwiched between the center panel element 24 and the outer closure flaps 20, when said outer closure flaps are moved to a closed position, so that all of the container end closure flaps will remain in a closed position, without automatically springing to an open position.

What is claimed is:

1. An end closure arrangement for a container, formed from a unitary blank of foldable paperboard and having pairs of opposed major and minor side wall panels foldably joined to each other to form a tubular body structure, said arrangement comprising:

(a) a pair of elongated, generally rectangular, outer closure flaps each including:

(i) an inner side edge foldably joined to an adjacent end edge of one of said major side wall panels along a first fold line;

(ii) a free outer side edge spaced from and parallel to said inner side edge;

(iii) said side edges having corresponding ends interconnected by end edges extending normal to and between said side edges;

(b) said outer closure flaps end edges interconnected by a pair of bellows members, each including:

(i) a generally triangular center panel element having a first edge foldably joined to an adjacent end edge of a related one of said minor side wall panels along a second fold line, and having a pair of second edges extending diagonally toward each other from opposite ends of said second fold line and converging at a location spaced from and aligned with a midpoint of said second fold line;

(ii) a pair of generally triangular side panel elements having first side edges foldably joined to adjacent end edges of related outer closure flaps along third fold lines, having free second edges extending from and normal to said first edges to said location, and having third edges extending diagonally between remote ends of said first and second edges;

(c) each of said side panel elements having end portions of each of its said third edges foldably joined to an adjacent one of said center panel elements second edges, along a pair of fourth fold lines spaced from each other, and having a central portion of each of its said third edges separated from an adjacent one of said center panel elements second edges by a generally U-shaped cut having a straight central portion and a pair of end portions extending from and normal to opposed ends of said central portion, whereby when said outer closure flaps are moved to a closed position said container end will remain in a closed position, without automatically springing to an open position, with said bellows member side panel elements interposed between said center panel element and said outer closure flaps.

2. A container end closure arrangement according to claim 1, wherein said bellows member side panel element free edges extend toward each other and meet adjacent an outer point of said center panel element.

3. A container end closure arrangement according to claim 1, wherein said U-shaped cut central portions are located within said center panel elements.

4. A container end closure arrangement according to claim 1, wherein said cut end portions extend from within said center panel elements to within said side panel elements.

5. A container end closure arrangement according to claim 1, wherein said fourth fold lines extend from opposite ends of said U-shaped cuts to opposite ends of said center panel second side edges.

6. A container end closure arrangement according to claim 1, wherein said fourth fold lines joining said bellows member center and side panel elements are offset from said cut center portions of said U-shaped cuts.

7. An end closure arrangement for a container, formed from a unitary blank of foldable paperboard and having pairs of opposed of major and minor side wall panels foldably joined to each other to form a tubular body structure, said arrangement comprising:

(a) a pair of elongated, generally rectangular, outer closure flaps each including:

(i) an inner side edge foldably joined to an adjacent end edge of one of said major side wall panels along a first fold line;

(ii) a free outer side edge spaced from and parallel to said inner side edge and interconnected by a pair of end edges;

(b) said outer closure flaps end edges interconnected by a pair of bellows members, each including:

(i) a generally triangular center panel element having a first edge foldably joined to an adjacent end edge of a related one of said minor side wall panels along a second fold line, and having a pair of second edges extending diagonally toward each other from opposite ends of said second fold line and converging at a location spaced from and aligned with a midpoint of said second fold line;

(ii) a pair of generally triangular side panel elements having first side edges foldably joined to adjacent end edges of related outer closure flaps along third fold lines, having free second edges extending from and normal to said first edges to said location, and having third edges extending diagonally between remote ends of said first and second edges;

(c) each of said side panel elements having end portions of each of its said third edges foldably joined to an adjacent one of said center panel elements second edges, along a pair of fourth fold lines spaced from each other, and having a central portion of each of its said third edges separated from an adjacent one of said center panel elements second edges by a generally U-shaped cut having a straight central portion and a pair of end portions extending from and normal to opposed ends of said central portion, whereby when said outer closure flaps are moved to a closed position said container end will remain in a closed position, without automatically springing to an open position, with said bellows member side panel elements interposed between said center panel element and said outer closure flaps.

8. A container end closure arrangement according to claim 7, wherein said bellows member side panel element free edges extend toward each other and meet adjacent an outer point of said center panel element.

9. A container end closure arrangement according to claim 7, wherein said U-shaped cut central portions are located within said center panel elements.

10. A container end closure arrangement according to claim 7, wherein said cut end portions extend from within said center panel elements to within said side panel elements.

11. A container end closure arrangement according to claim 7, wherein said fourth fold lines extend from opposite ends of said U-shaped cuts to opposite ends of said center panel second side edges.

12. A container end closure arrangement according to claim 7, wherein said fourth fold lines joining said bellows member center and side panel elements are offset from said cut center portions of said U-shaped cuts.

13. An end closure arrangement for a paperboard container, having pairs of opposed major and minor side wall panels, which arrangement includes a pair of rectangular outer closure flaps foldably joined to end edges of said major side wall panels, along first fold lines, and interconnected by a pair of bellows members each including a pair of triangular side panel elements foldably joined to the outer closure flaps, along second fold lines, and a triangular center panel element foldably joined to an end edge of a container minor side wall panel, along a third fold line, and to both side panel elements, along spaced fourth fold lines and separated from the side panel elements by U-shaped cut lines that enable the bellows panel elements, after being folded to closed position with the bellows side panel elements interposed between the end closure flaps and the center panel element, to remain in closed position without springing back to open position.

14. A container end closure arrangement according to claim 13, wherein said bellows member side panel element free edges extend toward each other and meet adjacent an outer point of said center panel element.

15. A container end closure arrangement according to claim 13, wherein said U-shaped cut central portions are located within said center panel elements.

16. A container end closure arrangement according to claim 13, wherein said cut end portions extend from within said center panel elements to within said side panel elements.

17. A container end closure arrangement according to claim 13, wherein said fourth fold lines extend from opposite ends of said U-shaped cuts to opposite ends of said center panel second side edges.

18. A container end closure arrangement according to claim 13, wherein said fourth fold lines joining said bellows member center and side panel elements are offset from said cut center portions of said U-shaped cuts.

19. A blank of foldable paperboard for use in forming an end closure for a container, said blank being cut and scored to provide:

(a) a first major side wall panel, a first minor side wall panel, a second major side wall panel, a second minor side wall panel, and a glue panel foldably joined to each other along parallel first fold lines to form a tubular body structure;

(b) pairs of opposed, elongated, generally rectangular, outer closure flaps foldably joined to opposite ends of each of said major side wall panels along second fold lines;

(c) pairs of opposed, generally rectangular, inner closure flaps foldably joined to opposite ends of each of said minor side wall panels along third fold lines;

(d) each of said inner closure flaps being arranged and dispose to form a bellows member for interconnecting corresponding ends of said outer closure flaps, when a container is erected from said blank, and comprising:

(i) a generally triangular center panel element having a first edge foldably joined to an adjacent end edge of a related one of said minor side wall panels along one of said third fold lines, and having a pair of second edges extending diagonally toward each other from opposite ends of said third fold line and converging at a location spaced from and aligned with a midpoint of said third fold line;

(ii) a pair of generally triangular side panel elements having first side edges foldably joined to adjacent end edges of related outer closure flaps and glue flap along fourth fold lines, having free second edges extending from and normal to said first edges to said location, and having third edges extending diagonally between remote ends of said first and second edges;

(iii) each of said side panel elements having end portions of each of its said third edges foldably joined to an adjacent one of said center panel elements second edges, along a pair of fourth fold lines spaced from each other, and having a central portion of each of its said third edges separated from an adjacent one of said center panel elements second edges by a generally U-shaped cut having a straight central portion and a pair of end portions extending from and normal to opposed ends of said central portion.

20. A blank according to claim 19 wherein said U-shaped cut central portions are located within said center panel elements, and said cut end portions extend from within said center panel elements to within said side panel elements.

* * * * *